United States Patent [19]

Gallusser et al.

[11] 4,278,317

[45] Jul. 14, 1981

[54] FORMED SOCKET CONTACT WITH REENFORCING RIDGE

[75] Inventors: David O. Gallusser, Oneonta; David L. Frear, Binghamton; Charles P. Fischer, Sidney, all of N.Y.

[73] Assignee: The Bendix Corporation, Southfield, Mich.

[21] Appl. No.: 71,638

[22] Filed: Aug. 31, 1979

[51] Int. Cl.[3] ..... H01R 11/22

[52] U.S. Cl. ..... 339/258 R

[58] Field of Search ..... 339/256 R, 258 R, 258 P, 339/259 R

[56] References Cited

U.S. PATENT DOCUMENTS

| | | | |
|---|---|---|---|
| 3,262,088 | 7/1966 | West | 339/258 R |
| 3,893,743 | 7/1975 | Wallo | 339/256 R |
| 4,072,394 | 2/1978 | Waldron et al. | 339/276 T |

FOREIGN PATENT DOCUMENTS

| | | | |
|---|---|---|---|
| 125794 | 10/1947 | Australia | 339/258 R |
| 709428 | 5/1931 | France | 339/256 R |

*Primary Examiner*—Neil Abrams

*Attorney, Agent, or Firm*—Paul J. Ethington; Raymond J. Eifler; Charles D. Lacina

[57] ABSTRACT

A socket contact is disclosed for miniature electrical connectors of the plug and receptacle type. The socket contact (10) comprises a contact sleeve (12) with two contact fingers (66) each extending as a cantilever beam from its root in the sleeve. A reenforcing ridge (68) in each finger extends from a point spaced from the free end of the contact finger to a point past the root of the finger to increase the stiffness of the finger. The radius of each finger and the location of the ridge thereon is such that the ridge is not engaged by a mating contact pin upon insertion into the socket.

5 Claims, 9 Drawing Figures

FORMED SOCKET CONTACT WITH REENFORCING RIDGE

TECHNICAL FIELD

This invention relates to electrical connectors of the plug and receptacle type; more particular it relates to socket contacts for such connectors.

BACKGROUND OF THE INVENTION

Electrical connectors of the plug and receptacle type are used in many applications for connecting multiple pairs of corresponding conductors. Such connectors are widely used in the aerospace field in complex electronic systems in which a single connector may interconnect hundreds of pairs of wires. In such systems, the connectors must be miniaturized to minimize the weight and size. The wires at the receptacle are connected to individual terminals and the wires at the plug are connected to corresponding terminals. Each of the terminals on one of the connector members is a socket contact and each of the terminals on the other member is a pin contact which is adapted to telescopically engage the corresponding socket contact when the plug and receptacle are in mated relationship. In order to miniaturize the connector, the pin and socket contacts need to be very small; for example, the socket contact may be less than one-tenth inch diameter and less than one-half inch long.

Connectors of the type described must be capable of quick and easy connection and disconnection without undue force. Yet each set of contacts must provide excellent electrical conductivity and be capable of repeated connection and disconnection without damage or significant deterioration. When miniature contacts were first introduced, they were manufactured by machining from metal stock since that was the only feasible way to hold the tolerances required for the mating contacts. However, machined contacts are relatively costly. In recent years such contacts have been made from sheet metal by forming and rolling to produce a "formed" contact.

Formed socket contacts have been developed which comprise an assembly of a contact sleeve or liner of spring metal having plural contact fingers at the mating end and a supporting sleeve thereon. The wire receiving end is provided with plural openings and has a supporting sleeve thereon and is crimped into engagement with the wire. Additionally, a mounting flange is provided in the midsection of the contact sleeve. In this construction, the inner sleeve has an open seam from one end to the other, i.e. the abutting edges of the rolled sleeve are not welded or brazed together. A socket contact of this construction and method of making it are described in U.S. Pat. No. 4,072,394 granted Feb. 7, 1978 to Waldron et al. and assigned to the same assignee as this application. Formed contacts with welded or brazed seams are disclosed in the following patents: U.S. Pat. No. 3,286,223 granted Dec. 15, 1966 to Narozoni et al., U.S. Pat. No. 3,317,887 granted May 2, 1967 to Henschen et al., and U.S. Pat. No. 3,721,943 granted Mar. 20, 1973 to Curr.

In a socket contact of the type described, the contact fingers constitute cantilever beams deflected in a radial direction by the insertion of the mating pin contact. Each of the contact fingers is supported only at its root in the contact sleeve. In order to provide a requisite retention force on the pin contact by the socket contact and insure a good electrical connection, it is necessary to have each finger exert an appropriate resisting force to radial deflection.

In socket contacts of very small size, especially those with an outer diameter of about 0.06 inch, the contact fingers must be of very thin material. There has been a problem of obtaining the requisite retention force with contacts of this size.

A general object of this invention is to provide an improved socket contact which overcomes certain problems of the prior art.

DISCLOSURE OF THE INVENTION

According to this invention, a socket contact of exceedingly small size is provided which exhibits an enhanced value of normal force on the inserted pin contact and therefore affords high retention force and good electrical contact. This is accomplished by a resilient contact sleeve with plural contact fingers, each extending as a cantilever beam from its root in the contact sleeve, and a reinforcing ridge in each finger to increase the stiffness or resistance of the finger to radial deflection. The reinforcing ridge extends beyond the root of the finger in the contact sleeve. Preferably, the reinforcing ridge on each contact finger extends from a point spaced from the free end of the contact finger to a point past the root of the finger. Further, the ridge is formed radially inwardly of the sleeve and is preferably in the form of a circular arc in cross-section.

In the preferred embodiment, the contact sleeve of resilient material defines two axially extending slots to provide a set of two equally spaced contact fingers each extending as a cantilever beam from its root in the contact sleeve. The sleeve is formed with an open seam extending from end to end with one of the slots being in alignment with the seam. The contact fingers are convergent toward each other at the free ends and a outer sleeve or hood forms a closed entry coaxial with the sleeve. Each of the contact fingers defines a radially inwardly directed ridge extending from a point spaced from the free end of the contact finger to a point past the ends of the slots. The spacing of the ridge from the free end of the contact permits the entry of the associated pin contact between the two fingers without engagement of the ridge. Further, the radius of each contact finger is such that the ridge does not engage the pin.

A more complete understanding of this invention may be obtained from the detailed description that follows taken with the accompanying drawings.

BEST MODE FOR CARRYING OUT THE INVENTION

Figures 1, 2, 3, 4, 5:
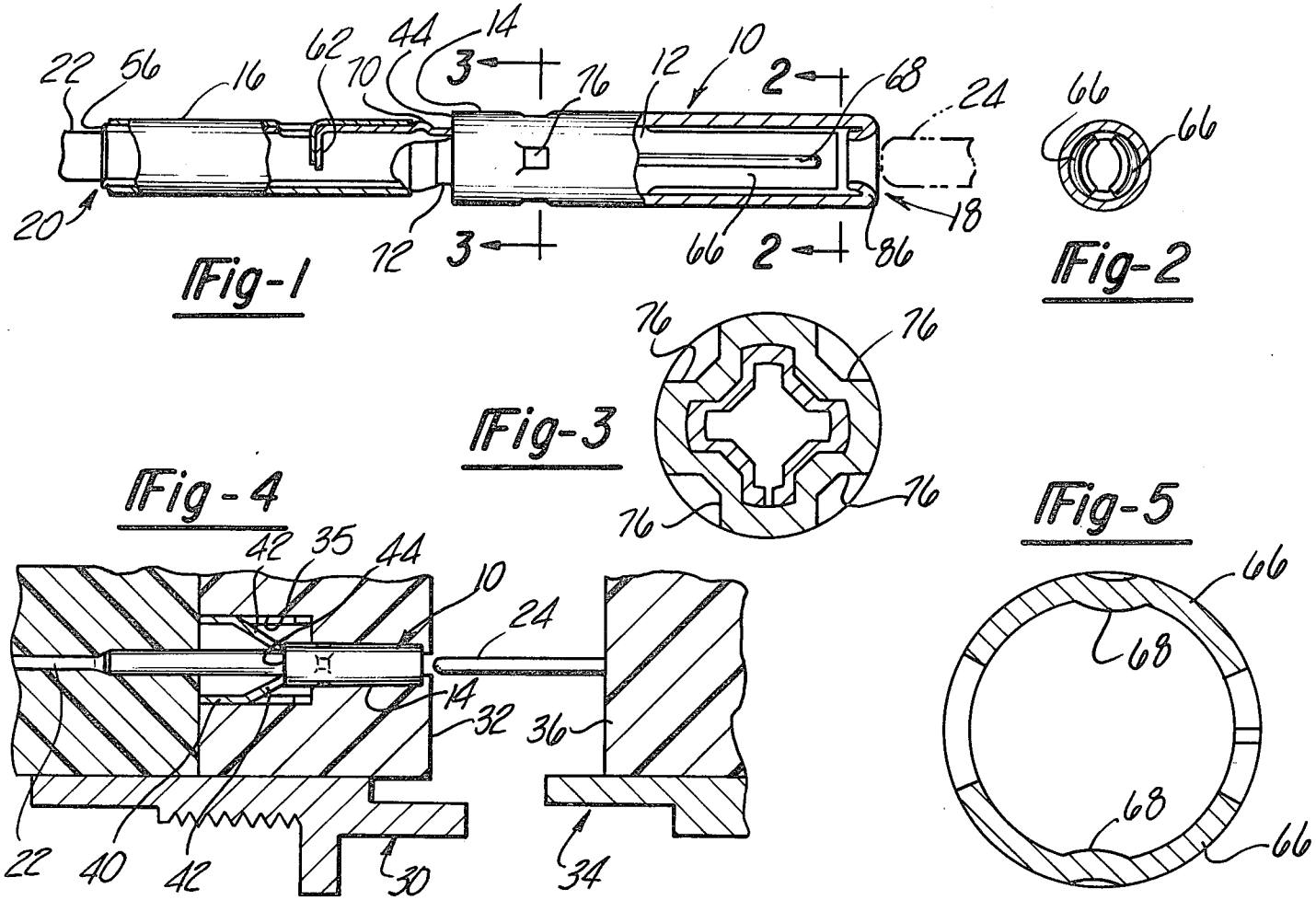
FIG. 1 shows a socket contact assembly in elevation with certain parts broken away.
FIG. 2 shows a section view taken on lines 2—2 of FIG. 1.
FIG. 3 shows a cross-sectional view taken on lines 3—3 of FIG. 1.
FIG. 4 shows the socket contact of this invention in an electrical connector.
FIG. 5 shows an enlarged cross-sectional view taken on lines 5—5 of FIG. 8.
Figure 6:
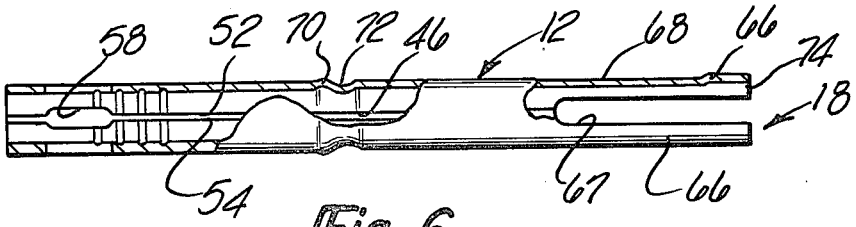
FIG. 6 shows an elevation view with parts broken away of the contact sleeve of the socket contact of this invention.

Referring now to the drawings, there is shown an illustrative embodiment of the invention in a socket contact especially adapted for use in separable electrical connectors. The socket contact comprises a contact liner of the formed type i.e. it is fabricated from thin sheet metal by stamping and rolling. The contact is adapted for mounting in a dielectric insert of an electrical connector member and for telescopic engagement with a pin contact mounted on a mating connector member. As the description proceeds, it will be appreciated that the invention is useful in other embodiments.

The socket contact, with the parts assembled, is shown in FIG. 1. In general, the socket contact 10 comprises a contact liner or inner sleeve 12, a front sleeve or hood 14 and a rear sleeve 16. The front hood 14 is disposed in telescoping relation over the contact sleeve 12 and extends from the pin receiving or mating end 18 to a point near the midsection of the contact sleeve 12. The back end of the contact 10 terminates in a wire receiving opening 20 which receives a conductor or wire 22. The mating end 18 at the front of the contact is adapted to receive a pin contact 24. Before proceeding with the detailed description of the socket contact 10, it will be helpful to consider the mounting of the socket contact in an electrical connector member.

FIG. 4 shows a fragmentary view of an electrical connector of the type of which the socket contact of this invention may be used. The electrical connector comprises a receptacle 30 which contains a dielectric insert 32 in which are mounted a plurality of socket contacts 10. The electrical connector also includes a plug 34 which contains a dielectric insert 36 in which are mounted a plurality of pin contacts 24. The receptacle 30 and the plug 34 are adapted to be oriented and drawn together in a mated relationship (by means not shown) so that the pin 24 is telescopically inserted into the socket contact 10 to provide an electrical connection therebetween. In this illustration, the insert 32 defines a recess 35 which contains a retention device 40. The socket contact 10 is mounted in the insert 32 by the contact retention device 40 which includes plural deflectable spring fingers 42 which engage the rearward shoulder 44 of the hood 14 on the socket contact 10. The socket contact 10 is inserted from the rear of the insert through the retention device and the spring fingers 42 deflect to allow the hood 14 to pass by and then the fingers seat against the rear shoulder 44 to hold the socket contact 10 in a fixed position within the insert.

Figure 7:
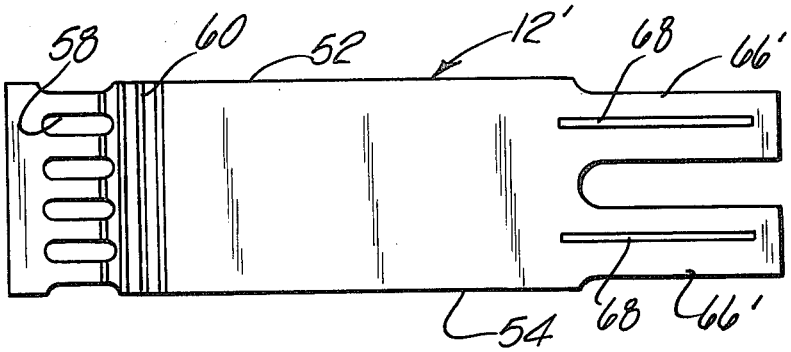
FIG. 7 shows a contact blank which has been stamped from sheet metal to form the contact sleeve.
Figure 8:
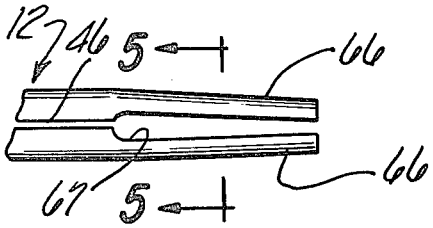
FIG. 8 is a fragmentary view of the contact sleeve after the contact fingers have been formed.
Figure 9:
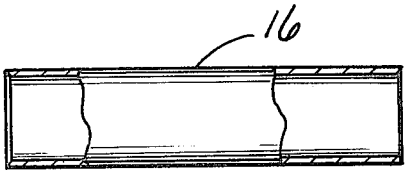
FIG. 9 is an elevation view with parts broken away of the rear sleeve of the socket contact.

The contact sleeve 12 is formed from a resilient sheet metal, preferably a beryllium copper alloy, by a stamping and rolling process. The process of forming the sleeve 12 is suitably that described in the above cited U.S. Pat. No. 4,072,394. A contact blank 12' which has been stamped from sheet metal for forming contact sleeve 12 is shown in FIG. 7. The contact sleeve 12 comprises a cylindrical sleeve having an open seam 46 which is formed by the abutting or closely spaced, longitudinally extending edges 52 and 54 of the sleeve 12. The contact sleeve 12 is provided with an outwardly directed annular shoulder 70 and an annular channel 72 in the midsection of the sleeve. The rear sleeve 16, which is disposed externally of the contact sleeve in telescopic relation, is a cylindrical tube, as shown in FIG. 9. The sleeve 16 extends from the shoulder 70 to the rearward or wire receiving end 20 which is provided with an oblique flange 56 to serve as a stop or locating shoulder for the sleeve 16. Adjacent the wire receiving end 20 of the contact sleeve the wall thereof defines a plurality of elongated openings 58 which are equally spaced circumferentially of the sleeve with one of the openings 58 being centered on the open seam 46. Adjacent the openings 58, the contact sleeve is provided with a plurality of annular inwardly directed ribs 60. As shown in FIG. 1, the wire receiving end 20 of the contact liner 12 receives the end of the wire 22. An inwardly directed wire stop or finger 62 is provided by lancing a portion of the walls of the sleeve 16 and the sleeve 12. The wire 22 is stripped of insulation at its end and the bare conductor is inserted into the contact sleeve 12 and seated against the stop finger 62. When the socket contact is to be installed on the wire 22 for use in a connector, the double wall thickness of the sleeve 12 and the supporting sleeve 16 is crimped inwardly against the bare wire to provide a good electrical and mechanical connection.

Contact sleeve 12 is provided with two equally spaced tines or contact fingers 66 at the forward or mating end 18 of the sleeve 12. The contact fingers 66 are formed by punching the sheet metal of the contact blank to form fingers 66'. When the sleeve is formed by rolling, the fingers 66 are separated by slots 67. Additionally, each contact finger is formed with a reinforcing ridge 68 which extends axially of the sleeve 12 from a point spaced from the free end of the finger to a point past the root of the finger, i.e. at the ends of the slots. As will be noted with reference to FIG. 5, the ridges 68 are formed with a substantially circular arc in cross-section. After forming, the sleeve 12, in that portion extending from the root of the fingers 66 to the free ends of the fingers, is tapered to a smaller diameter at the mating end 18. In other words, each of the contact fingers 66 extends radially inwardly at its free end. The span between the edges of each contact finger 66 is less than the radius of pin contact 24 and also, the ridge on each finger is set back or spaced from the end of the finger. As a result, the edges of the contact fingers engage the contact pin upon entry thereof into the socket contact, but the ridges do not. Additionally, the free ends of the fingers 66 are coined to provide bevelled ends 74 to facilitate entry of the pin contact into the contact sleeve 12. The ridges 68 may be formed to extend radially outwardly and this would further increase the resistance to deflection but would require more space.

The front sleeve or hood 14, as shown in FIGS. 1 and 3 is a cylindrical tube disposed in external telescopic relation with the contact sleeve 12. The hood 14 is preferably made of stainless steel and has a wall thickness of a few thousands of an inch. The forward end of the hood 14 provides a closed entry for the socket contact by an inwardly turned annular bight 86. The rearward end of the hood 14 is located adjacent the annular channel 72 on the sleeve 12. With the hood 14 positioned on the contact sleeve 12, the hood is secured in position by prick punching to provide indentations 76 rearwardly of the contact fingers 66 as shown in FIGS. 1 and 3. At the forward end of the hood 14 the annular bight 86 provides a closed entry for the socket adapted to guide the mating contact pin 24 into centered relationship with the contact fingers 66. For this purpose, the inside diameter of the annular bight 86 is substantially the same as the outside diameter of the bevelled surfaces 74 and there is a small axial spacing between the end of the bight 86 and the ends of the fingers.

As described above, the socket contact 10, as shown in FIG. 1, is connected with a wire 22 and is mounted in a connector as shown in FIG. 4. In use of the connector, the pin contact 24 on the plug 34 is axially aligned with the socket contact 10 and when the plug and receptacle are drawn together the pin contact 24 is telescopically inserted into the socket contact 10. As the pin contact 24 enters the socket contact, the contact fingers 66 are first engaged by the pin at the bevelled surfaces 74 which facilitate entrance of the pin contact. The pin is engaged by the edges of the contact fingers because of its smaller span but the pin does not engage the ridges 68. This minimizes the axial loading on the contact fingers. The contact fingers are radially deflected as the pin contact enters the socket contact. The normal force exerted by each of the contact fingers against the pin contact is enhanced by the stiffening effect of the ridges 68. Consequently, an enhanced electrical and mechanical connection is maintained.

Although the description of this invention has been given with reference to a particular embodiment, it is not to be construed in a limiting sense. Many variations and modifications will now occur to those skilled in the art. For a definition of the invention, reference is made to the appended claims.

We claim:

1. In a separable electrical connector of the type including first and second connector members, one of said members being a receptacle and the other being a plug adapted to mate with the receptacle, each of said members including a dielectric insert, at least one socket contact mounted in the insert, at least one socket contact mounted in the insert of one member, the socket comprising a contact sleeve of resilient metal and having a mating end and a wire receiving end, a pin contact corresponding to the socket contact and being mounted in the insert of the other member and adapted for telescopic engagement with the mating end of the socket contact when the plug and receptacle are in mated relationship, the improvement wherein the wall of said contact sleeve defines plural slots extending axially from the mating end thereby providing plural contact fingers with each contact finger extending as a cantilever beam from its root in the contact sleeve adjacent the ends of the slots and terminating at a free end, each of said fingers including a radially inwardly directed ridge which extends axially of the respective contact finger whereby each contact finger is stiffened by said ridge, each ridge on each respective contact finger extending from a point spaced from the free end of the contact finger to a point past the ends of said slots, each free-end of said contact finger being inwardly concave for engaging said pin, the ridge deflecting so that it is positioned laterally opposite of the inserted pin and out of contact therewith.

2. The invention as defined in claim 1 wherein the contact sleeve defines two equally spaced slots thereby providing two equally spaced contact fingers.

3. The invention as defined in claim 1 wherein said ridge is a circular arc in cross-section.

4. A socket-type contact comprising:

a cylindrical shaped sleeve of conductive material having a forward end and a rearward wire receiving end;

at least two equiangularly spaced contact fingers cantilevered to the forward end of the sleeve, each finger having a root end secured to the sleeve and a distal end extending axially therefrom; and an axially extending semi-circularly shaped ridge disposed on each contact finger, each of said ridges having a forward end spaced axially rearward from the distal end of the contact finger and a rearward end spaced axially rearward of the root end of the contact finger, each of said ridges being substantially diametrically opposite one another and each extending radially inwardly from the respective contact finger, each said contact finger distal end being inwardly concave for engaging an inserted pin, the ridge deflects so that it is positioned laterally opposite of the inserted pin and out of contact therewith.

5. A socket-type contact for use with a pintype contact, said socket-type contact comprising:

a contact sleeve of resilient conductive material having a forward pin mating end and a rearward wire terminating end; and a cylindrical tube disposed in external telescopic relation with and having a rearward end portion secured to an intermediate portion of the contact sleeve;

said contact sleeve being open at the forward end and including a plurality of arcuately shaped contact fingers extending as cantilever beams from their roots in the sleeve with each contact finger being separated by a longitudinal slot; and a plurality of longitudinally extending reinforcing ridges, each ridge being centrally disposed on a respective contact finger and each ridge having a forward end spaced rearwardly of the finger end and a rearward end spaced rearwardly of the roots, each of the ridges being directed radially inwardly towards one another from their respective contact fingers and from the cylindrical tube, such that when the pin-type contact is received by the forward ends of the contact fingers, the ridge deflects so that it is positioned laterally opposite of the inserted pin and out of contact therewith, each said contact finger forward end being inwardly concave for engaging said pin.

* * * * *